US006736644B1

(12) United States Patent
Vaughn

(10) Patent No.: US 6,736,644 B1
(45) **Date of Patent: *May 18, 2004**

(54) AUDIO AND VISUAL MESSAGE CENTER

(76) Inventor: Larry F. Vaughn, 1158 Mansfield Ave., Indiana, PA (US) 15701

( * ) Notice: Subject to any disclaimer, the term of this patent is extended or adjusted under 35 U.S.C. 154(b) by 45 days.

This patent is subject to a terminal disclaimer.

(21) Appl. No.: 09/929,620

(22) Filed: Aug. 14, 2001

Related U.S. Application Data

(63) Continuation-in-part of application No. 09/391,145, filed on Sep. 7, 1999.

(51) Int. Cl.[7] ..... B43L 1/00
(52) U.S. Cl. ..... 434/408
(58) Field of Search ..... 434/365, 408, 434/430; 40/611, 618; 704/272; 428/81, 99, 192; 368/41, 223, 240

(56) References Cited

U.S. PATENT DOCUMENTS

| | | | | |
|---|---|---|---|---|
| 3,999,050 | A | | 12/1976 | Pitroda |
| 4,045,897 | A | | 9/1977 | Gates |
| 4,618,151 | A | | 10/1986 | Fadner et al. |
| 4,767,119 | A | | 8/1988 | Fadner et al. |
| 4,797,914 | A | | 1/1989 | Vaello |
| D311,026 | S | | 10/1990 | DePoyster |
| 5,067,573 | A | * | 11/1991 | Uchida ..... 345/173 |
| 5,199,009 | A | | 3/1993 | Svast |
| 5,241,494 | A | | 8/1993 | Blyth et al. |
| 5,259,024 | A | | 11/1993 | Morley, Jr. et al. |
| 5,267,900 | A | | 12/1993 | Clayton |
| D343,859 | S | | 2/1994 | Fisher |
| 5,360,345 | A | | 11/1994 | Brauner et al. |
| 5,387,108 | A | | 2/1995 | Crowell |
| 5,425,078 | A | | 6/1995 | Stern |
| 5,463,369 | A | | 10/1995 | Lamping |
| 5,490,206 | A | | 2/1996 | Stern |
| 5,504,836 | A | | 4/1996 | Loudermilk |
| 5,577,918 | A | | 11/1996 | Crowell |
| 5,637,417 | A | * | 6/1997 | Engmark et al. ..... 429/97 |
| 5,654,870 | A | * | 8/1997 | Havener ..... 361/600 |
| 5,655,323 | A | | 8/1997 | Lassoff |
| 5,755,338 | A | | 5/1998 | vom Braucke et al. |
| 5,768,349 | A | * | 6/1998 | Knuth et al. ..... 379/88.22 |
| 5,798,686 | A | | 8/1998 | Schreiner |
| 5,836,616 | A | | 11/1998 | Cooper |
| 5,876,067 | A | | 3/1999 | Kaplan |
| 5,890,121 | A | * | 3/1999 | Borcherding ..... 704/272 |
| 5,903,869 | A | | 5/1999 | Jacobson et al. |
| 5,948,498 | A | * | 9/1999 | Bianco et al. ..... 428/81 |
| 5,987,825 | A | * | 11/1999 | Rosen ..... 52/36.1 |
| 6,002,779 | A | | 12/1999 | Johnston |
| 6,007,891 | A | | 12/1999 | Davis et al. |
| 6,405,465 | B2 | * | 6/2002 | Dwyer et al. ..... 473/457 |

* cited by examiner

*Primary Examiner*—Kurt Fernstrom
(74) *Attorney, Agent, or Firm*—Luedeka, Neely & Graham PC

(57) ABSTRACT

The invention relates to a message center including a substantially rectangular tray having side walls, a raised peripheral edge adjacent the side walls and at least one raised dividing wall having dividing wall ends, the dividing wall being connected on its ends to the raised peripheral edge defining at least first and second recessed sections. One of the recessed section includes a non-electronic visual display component. A second recessed section includes an audio record/playback device. At least one of the side walls contains an opening for holding a writing utensil. The message center also includes a back cover attached to the tray defining a cavity on an opposite side of the tray from the recessed sections between the back cover and the tray, the back cover including means for attaching the message center to a surface.

15 Claims, 6 Drawing Sheets

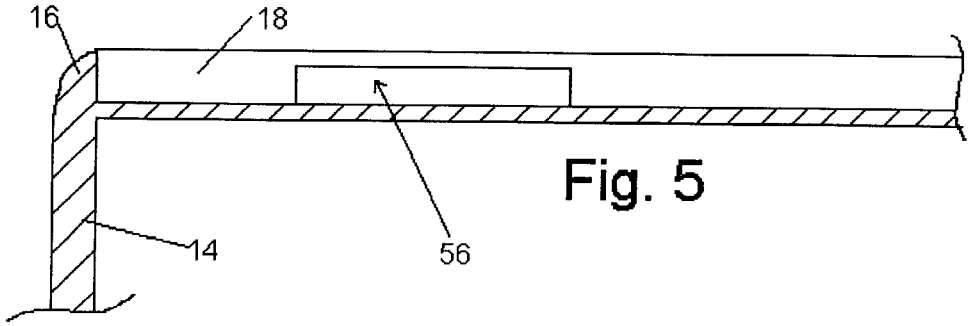
Fig. 5
Fig. 4
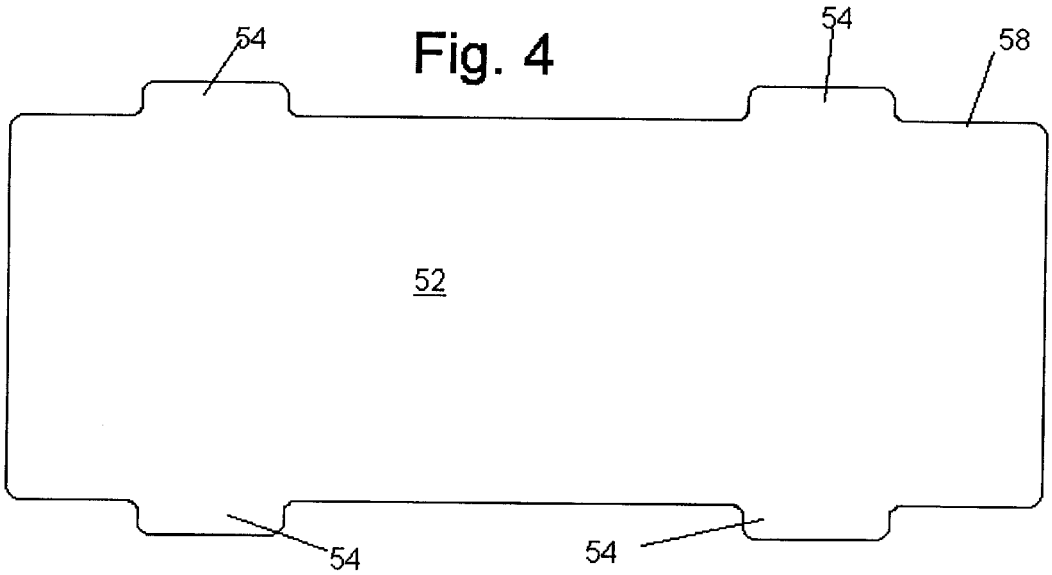
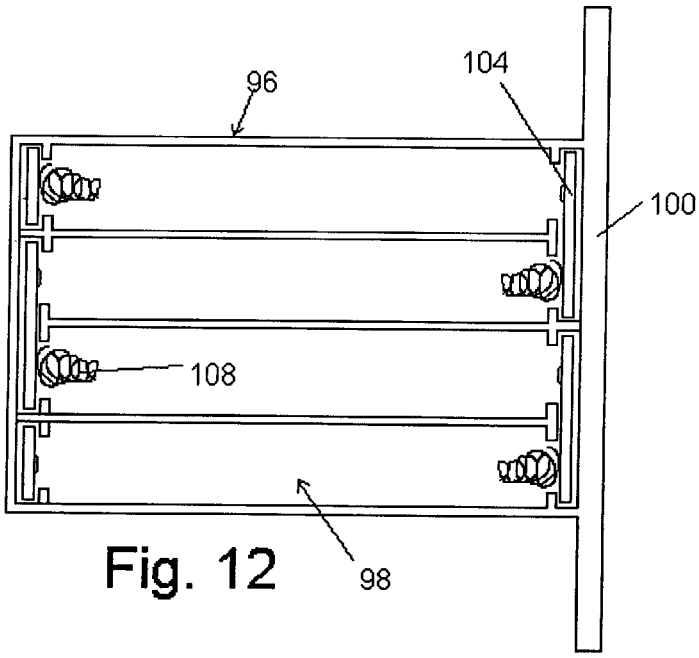
Fig. 12
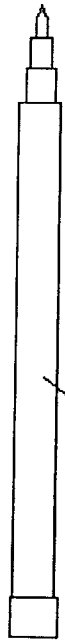
Fig. 3

AUDIO AND VISUAL MESSAGE CENTER

This application is a continuation-in-part of application Ser. No. 09/391,145, entitled "AUDIO AND VISUAL MESSAGE CENTER", filed on Sep. 7, 1999.

FIELD OF THE INVENTION

The invention relates to a message display device and more specifically to a device for posting non-electronic visual messages and electronic messages.

BACKGROUND

A wide variety of visual message display devices such as bulletin boards, cork boards, erasable marking boards and felt boards have been produced. Such devices are typically designed to communicate by a single visual means. However, it may be difficult to adequately address all of the communication needs of a home, office or school by use of a single visual means. Individuals often have busy and varying schedules and require more information be communicated quickly as their lives become more hectic. Family members, students and co-workers often have different schedules or rotating shifts and are not commonly available to give and/or receive general information at the same time.

There is a need, therefore, for a means of multiple communication which is adaptable to provide sufficient information in order to adequately communicate with individuals at home, school or in the office.

SUMMARY

With regard to the foregoing and other objects, the invention provides a message center including a substantially rectangular tray having side walls, a raised peripheral edge adjacent the side walls and at least one raised dividing wall having dividing wall ends, the dividing wall being connected on its ends to the raised peripheral edge defining at least first and second recessed sections. The first recessed section includes a non-electronic visual display component selected from the group consisting of an erasable board, a calendar, a pressure sensitive adhesive surface area, a cork board, a felt pad, a clip board, a note pad, a metal surface and a display area having a removable transparent film. The second recessed section includes an audio record/playback device. At least one of the side walls contains an opening for holding a writing utensil. The message center also includes a back cover attached to the tray defining a cavity on an opposite side of the tray from the recessed sections between the back cover and the tray, the back cover including means for attaching the message center to a surface.

In another aspect, the invention provides a message center for visual and electronic messages. The message center includes a molded rectangular tray having side walls. The tray contains at least three recessed areas between the side walls on a first side thereof and raised dividing walls connected to the side walls defining the three recessed areas. The second side of the tray contains a cover attached to the tray providing a cavity between the cover and the tray, the cover containing means for attaching the tray to a substantially vertical surface. At least two of the recessed areas include interchangeable non-electronic visual display devices selected from the group consisting of erasable board, a calendar, a pressure sensitive adhesive surface area, a cork board, a felt pad, a clip board, a note pad, a metal surface and a removable transparent display area. The third recessed area contains a digital audio record/playback device.

An advantage of the invention is that it provides a relatively inexpensive, expedient and simple means for communicating important information to family members, students, co-workers or others through a variety of communication means. The communication device described herein is adaptable for a variety of non-electronic visual media and includes a record/playback section for audio messages which greatly enhances the visual messages which may be posted on the message center. The communication device described herein also has the advantage of providing a backup or secondary means of communication, therefore improving the likelihood that messages will not be lost if there is an unintentional removal of either the audio or visual message.

BRIEF DESCRIPTION OF THE DRAWINGS

The above and other features, aspects and advantages of the present invention will now be discussed in the following detailed description and appended claims considered in conjunction with the accompanying drawings in which:

FIG. 3 is a plan view of a writing utensil for an audio and visual message center according to the invention;

FIG. 4 is a plan view of a transparent protective film for use with an audio and visual message center according to the invention;

FIG. 5 is a partial cross-sectional view an audio and visual message center according to the invention;

FIG. 12 is a top plan view of a battery holder for an audio and visual message center according to the invention.

DETAILED DESCRIPTION OF A PREFERRED EMBODIMENT

Figure 1:
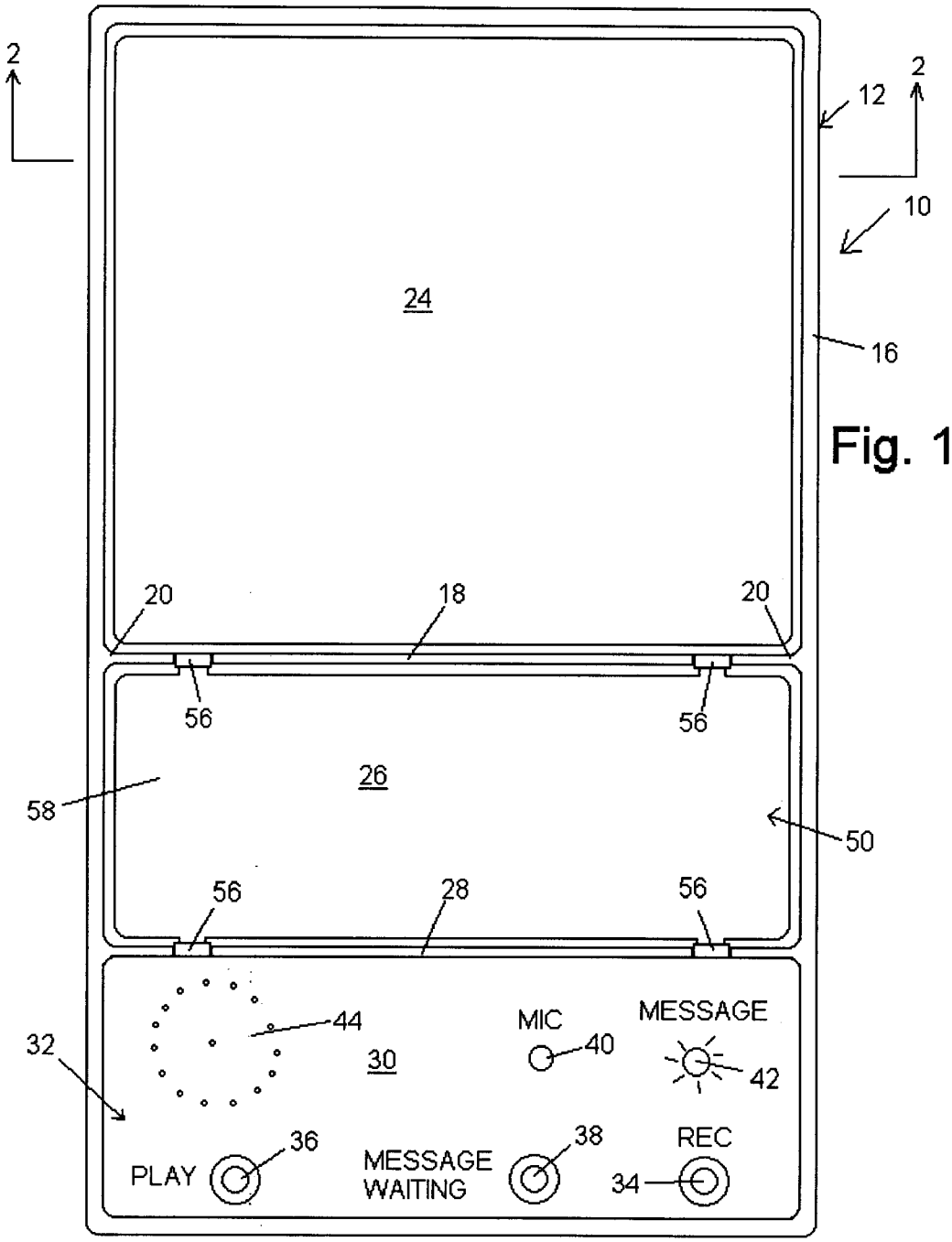
FIG. 1 is a top plan view of an audio and visual message display device according to the invention.
Figure 2:
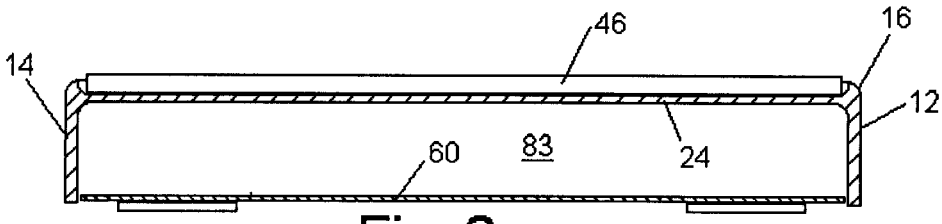
FIG. 2 is a cross-sectional view of an audio and visual message center according to the invention.

Referring now to the drawings in which like reference characters designate like or similar parts throughout the several views, FIG. 1 illustrates a message center 10 according to the present invention. The message center 10 includes a tray 12 having side walls 14 (FIG. 2), a raised peripheral edge 16 adjacent the side walls 14 and at least one raised dividing wall 18. The dividing wall 18 has dividing wall ends 20 and 22 which are connected to the raised peripheral edge 16 thereby defining recessed sections 24 and 26. The tray 12 also preferably contains at least a second raised dividing wall 28 defining a third recessed section 30. A cross-sectional view of the raised peripheral edge 16 and the recessed section 24 is illustrated in FIG. 2.

Sections 24 and 26 of the tray 12 preferably contain one or more non-electronic visual display components that allow a user to post visual messages to other users of the message center 10 in a variety of ways. Sections 24 and 26 can be of any size or orientation required to provide one or more non-electronic visual display areas, as required, and may be further divided by additional raised dividing walls to provide additional recessed sections. Section 30 preferably contains an audio record/playback device 32 containing operating features on its face, such as a record switch 34, a play switch 36, a message waiting switch 38, a microphone 40, a message indicator 42 and a speaker 44.

The tray 12 including side walls 14, raised peripheral walls 16, raised dividing walls 18 and 28 and recessed sections 24, 26 and 30 is preferably made from a thermoplastic material in a molding or thermoforming process. The side of the tray opposite the recessed sections 24, 26 and 30 provides a cavity which may include formed sections and areas for attaching a cover thereto as described in more detail below with reference to FIG. 9.

Various non-electronic visual display components may be attached in recessed sections 24 and 26 (FIG. 1). Such components may be selected from a calendar, an erasable board, a pressure sensitive adhesive surface area, a clip board, a cork board, a metal surface, a note pad, a felt pad, a display area having a removable transparent film or any combination of two or more of the foregoing. With regard to the individual non-electronic visual display components, section 24 preferably contains an erasable board, section 26 contains a interchangeable display area and removable transparent film. It will be recognized that the configuration of sections 24, 26 and 30 and their positions in the tray 12 relative to one another is not critical to the invention and each section may be rearranged in any orientation to provide the features of the invention.

The non-electronic visual display components may be removably attached or permanently attached in the recessed sections. When erasable board is included in section 24 or 26, the erasable board may include any common dry erase board 46 or chalk board. A writing utensil 48 (FIG. 3), such as chalk or a dry erase marker, is preferably provided for use with the board 46 so that a family member, student or co-worker can write messages or reminders on the surface of the board 46. In the alternative, the visual display component may include a clip board which enables notes and note pads to be mounted and retained thereon by a spring actuated retaining device. A cork board which provides convenient note posting thereon with tacks, or staples may be used in place of or in addition to the dry erase board. Likewise, a metal surface which provides convenient note posting with household magnets or provides a magnetic surface for attaching metal clips or metal holders thereto may be used in addition to or in the alternative to the dry erase board 46. Other non-electronic visual display devices include a note pad which provides a surface for writing messages thereon and which is preferably removably mounted to the tray 12 to allow for replacement of an expended pad. It will be recognized that various combinations and/or placements of two or more of the foregoing non-electronic visual display components may attached to the tray and used with the audio record/playback device 32.

A plurality of substantially congruent non-electronic visual displays may be provided with the tray 12 for an interchangeable message center 10 which may be customized by the user thereof. Thus, a family member, student or co-worker may choose and replace each of the visual display components with other like sized display components that better fit his or her particular needs. In order to removably mount the visual display components in sections 24 and 26 thereof, the tray 12 may include slots, adhesive surfaces, hook and loop fasteners, button fasteners, snap fasteners or any other means for removably attaching the non-electronic visual display components to the tray 12.

In a preferred embodiment, section 26 of the tray includes a display area 50 including a removable transparent film 52 attached in section 26 of the display area 50. The transparent film 52 is preferably a flexible film 52 having tabs 54 thereon (FIG. 4) for insertion into tab receiving slots 56 in the raised dividing walls 18 and 28 (FIGS. 1 and 5). The film 52 is thus removable from section 26 so that various cards, notes, advertising and the like may be inserted in section 26 and protected by film 52. For relatively thin materials inserted under film 26, one end of the film, such as end 58 may be slightly raised without removing the tabs 54 from slots 56. The substantially transparent film may also contain permanent indicia thereon for indicating days the week, months of the year, schedules, frames or indicia for recording temporary messages thereon.

Figure 6:
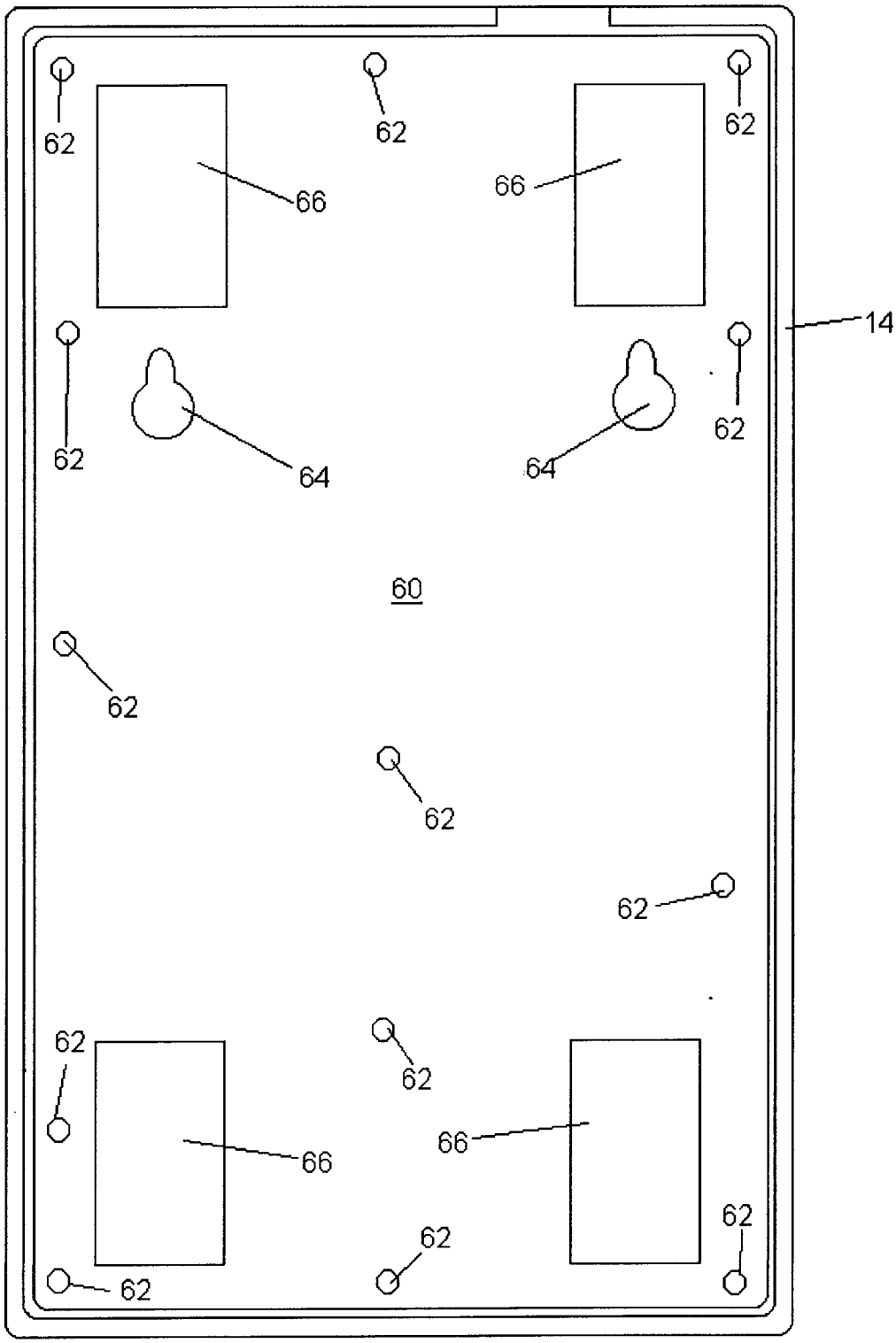
FIG. 6 a plan view of a second side of side an audio and visual message center according to the invention.

With reference to FIG. 6, the side of the tray opposite sections 24, 26 and 30 provides a cavity which is preferably closed by a cover 60 made of paperboard or any other suitable material. The cover 60 is attached to the tray 12 by adhesive, snaps, screws 62 and the like. The cover 60 preferably includes openings 64 therein for attaching the message center 10 to a surface such as a wall. Other means for attaching the message center 10 to a surface may include adhesives, magnets 66 or wire loops, hook and loop material and the like.

Various record/playback devices 32 may be used in the section 30 of the message center 10. The record/playback device 32, as shown in detail in FIG. 1, provides an audio massaging system for use in conjunction with the non-electronic visual display components described above. Operation of such a device 32 should preferably remain simple and convenient. As shown, the operating features of the device 32 include depressible record 34, play 36 and message waiting 38 switches which may be push button single throw switches, toggle switches, micro-switch and the like. Other features of the device 32 include a speaker 44, a microphone 40, and/or a flashing message indicator LED 42 to alert another person that an audio message has been recorded.

To provide an audio message, a family member, student or co-worker may depress and hold the record switch 34, speak through the microphone 40 with the desired message, then release the record switch 34 and depress the message waiting switch 38. The message is now stored for retrieval and the message waiting indicator 42 will blink. To retrieve a message, the person for whom the message was intended may simply press the play switch 36 to hear the recorded message through the speaker 44. After receiving the message, the message waiting switch 38 may again be depressed to turn off the message waiting indicator 42. With the aforementioned device 32, the message is erased when the next message is recorded.

Figure 7:
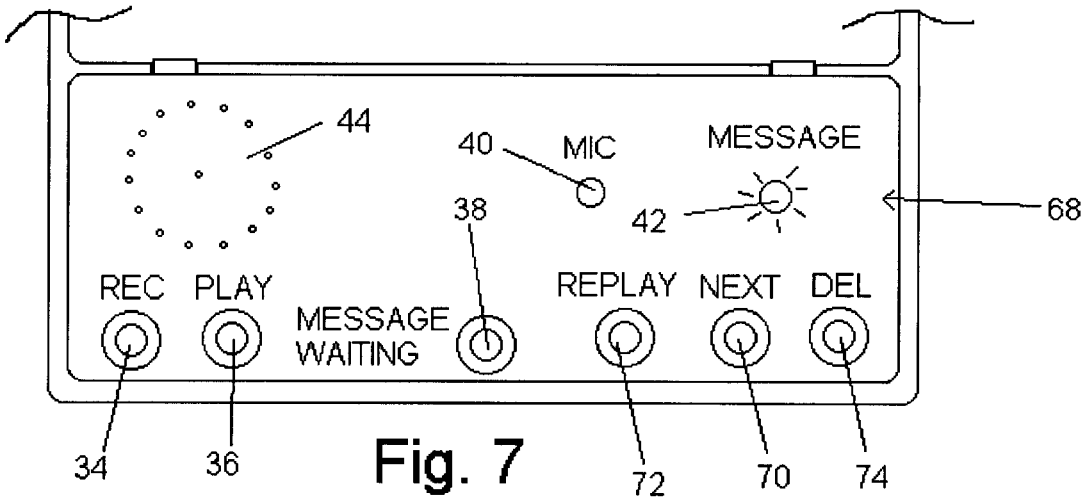
FIGS. 7 and 8 are plan views of alternate audio playback and recording devices for an audio and visual message center according to the invention.

In the alternative, an audio record/playback device 68 capable of storing multiple messages in a queue, as in FIG. 7, may be provided in section 30 of tray 12. In this embodiment, the device 68 includes additional common record/playback features such as a next message switch 70, a replay switch 72 and a delete switch 74 in addition to the record, play and message waiting switches 34, 36 and 38. A message may be recorded on the device 68 in the same manner as described above with reference to device 32. Consecutive messages may also be stored on the device 68 without erasing a previous message. When messages are played, the user may depress and release the next message switch 70 to skip to the desired message in the queue, depress and release the replay switch 72 to return to a previous message in the queue, or depress and release the delete switch 74 to erase the current message in the queue.

Figure 8:
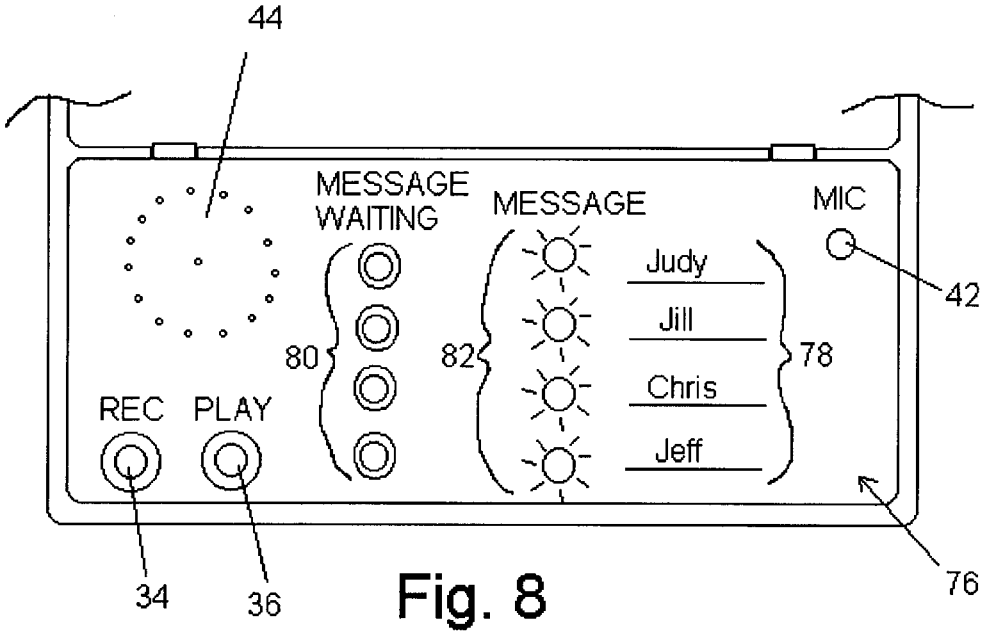

According to another aspect of the invention shown in FIG. 8, an audio record/playback device 76 for use in the section 30 of the message center 10 may include a plurality of electronic mailboxes to support storing messages for separate users. The plurality of electronic mailboxes are provided in a visual menu format 78 for each user. Mailbox selection switches 80 next to each user designation provide address inputs which correspond to that user's electronic message mailbox to be used with the record and play switches 34 and 36. Also included are message indicators 82 adjacent the mailbox menu 78 to indicate which users have messages posted on the system. To provide a message, the family member, student or co-worker depresses and releases the particular user selection switch 80, then depresses and holds the record switch 34, speaks through the microphone 42 with the message for the selected person, then releases the record switch 34. The message is now stored for retrieval as indicated by the corresponding message indicator 82. To retrieve a message from an electronic mailbox, the person for whom the message was intended depresses and releases the user selection switch 80 then depresses and releases the play switch 36 to hear the recorded message through speaker 44. The multiple message system described in FIG. 8 and other mailbox interfaces such as alpha and/or numeric keypads, LCD interfaces, etc. may also be incorporated in any of the record/playback devices 32, 68, or 76 described above.

The preferred embodiment of the invention includes battery operated digital voice recording circuits, however audio tape recording circuits which may be battery operated or operated by alternating current are an acceptable alternative. The digital voice recording and playback circuits may be any commercially available digital recording devices, such as single chip recording devices as disclosed in U.S. Pat. No. 5,241,494 to Blyth et al. entitled "Integrated Circuit System for Analog Recording and Playback", and are available under the name CHIPCORDER® from Information Storage Devices, Inc. of San Jose, Calif. The design and operation of such devices is described in U.S. Pat. No. 5,241,494, the disclosure of which is incorporated herein by reference as if fully set forth.

Figure 9:
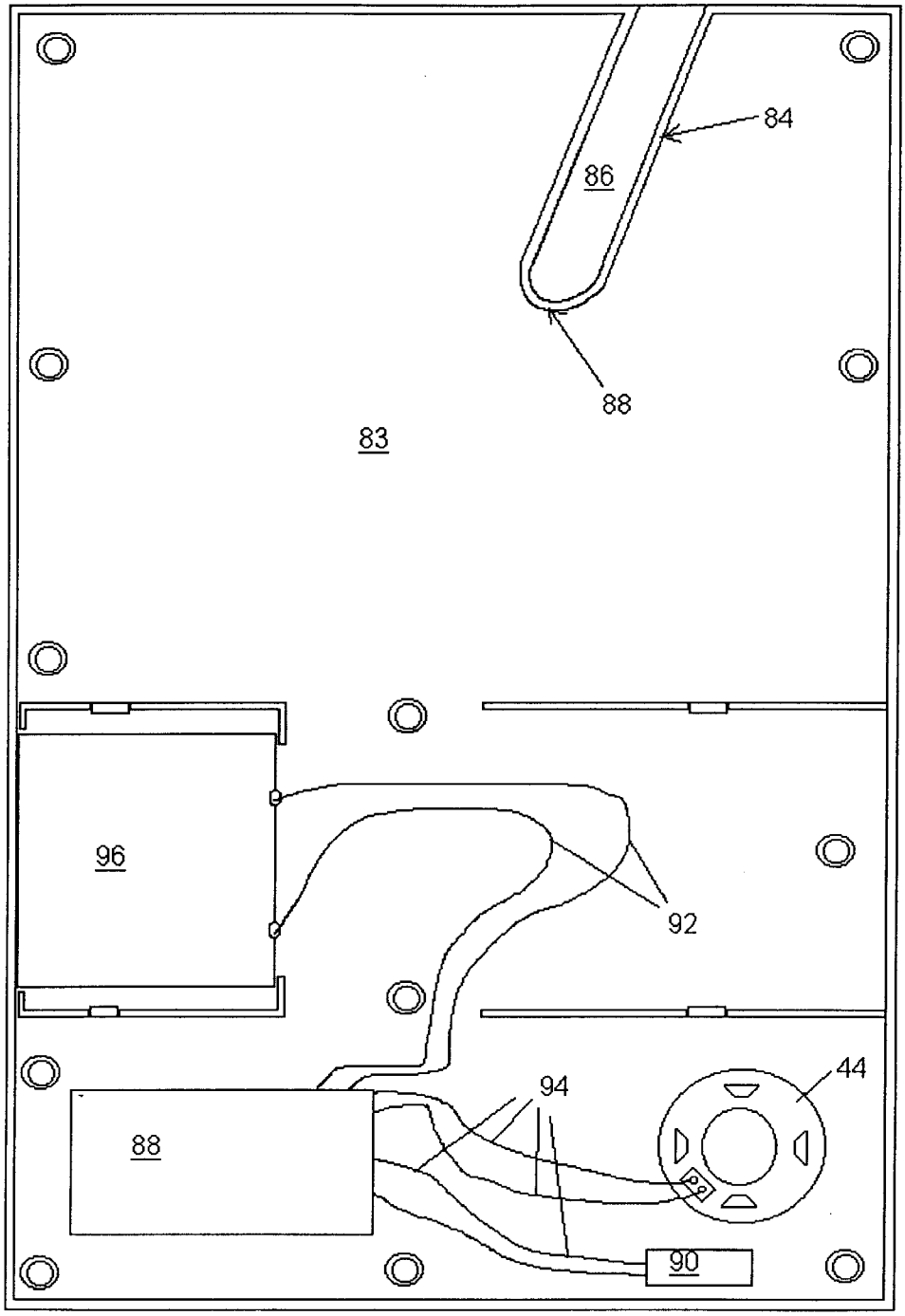
FIG. 9 is a plan view from a second side of an audio and visual message center according to the invention with a back cover portion removed.
Figures 10, 11:
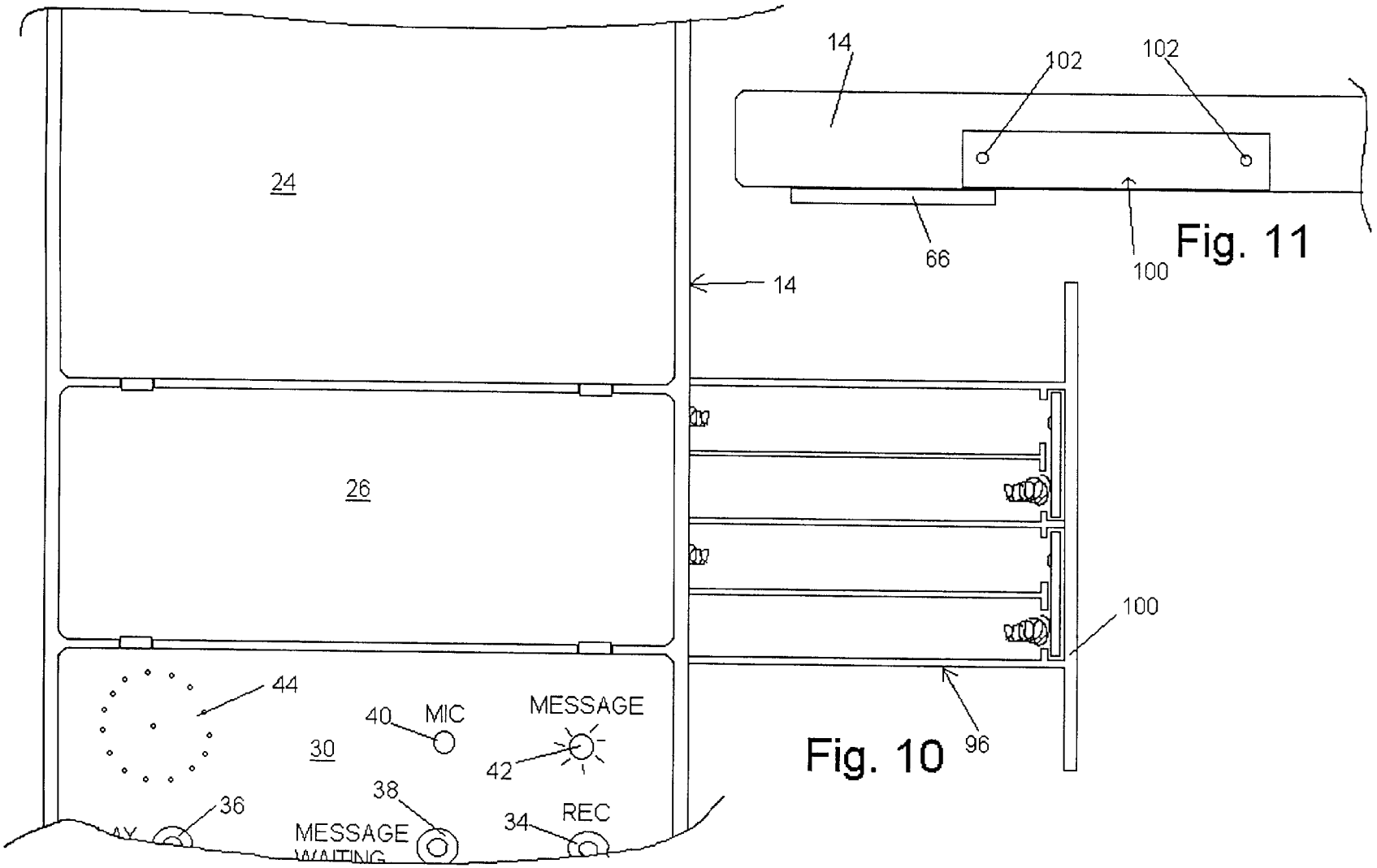
FIG. 10 is a partial plan view of an audio and visual message center and battery compartment according to the invention.
FIG. 11 is an elevational view of an audio and visual message center and battery compartment according to the invention illustrating the location of a battery compartment for the message center.

The electronic components of the audio/playback device 32, 68 or 76 are attached to the tray 12 on a side opposite sections 24, 26 and 30 in cavity 83 as shown in FIG. 9. Cover 60 is attached to the tray to protect the electronic components and to provide a closed cavity 83 as shown in FIG. 6. The components attached to the tray may include a speaker 44, a circuit board 88 containing audio record and memory devices, a switch board 90 containing, recored, play and/or message switches as described above, interconnecting wires 92 and a battery holder compartment 96. Wires 92 should be of sufficient length to permit the battery compartment 96 to slide in and out of side wall 14 as shown in FIGS. 10 and 11.

A plan view of the battery compartment 96 is illustrated in FIG. 12. The battery compartment 96 preferably includes a rectangular drawer 98 having a flange section 100 attached to the drawer 98. The flanged section 100 may include apertures 102 therein for attaching the drawer 98 in a closed orientation to the tray 12. The drawer 98 also includes metal contacts, such as contacts 104 and 108 for electrical operation of the play/back record device 32. Permanent, or semipermanent batteries may also be used or the record/playback device 32 may be operated with by other electric sources such as alternating current or solar energy. Each of the components in cavity 83 may be attached by adhesives, screws, snaps or other means known to those skilled in the art.

Figure 13:
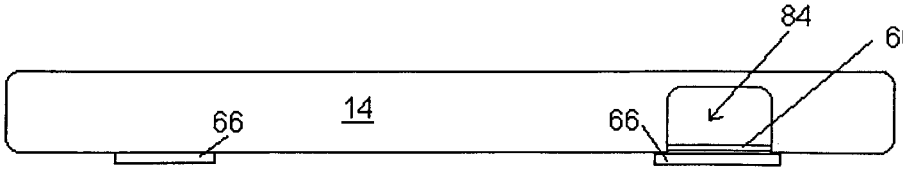
FIG. 13 is a side elevational view an audio and visual message center according to the invention illustrating a writing utensil holder.

Also illustrated in FIGS. 9 and 13 is a writing utensil holder 84 which is preferably molded with the tray 12 in one of the side walls 14 thereof to provide an elongate trough 86 which is closed on one end 88 thereof. As shown in detail in FIG. 13, the cover 60 provides a closed trough 86 when the cover 60 is attached to the tray 12. The writing utensil holder may be located in any of the side walls 14 or may be attached to the tray 12 using a separate holder device or by adhesive, hook and loop material and the like.

It is contemplated, and will be apparent to those skilled in the art from the foregoing specification, drawings, and examples that modifications and/or changes may be made in the embodiments of the invention. Accordingly, it is expressly intended that the foregoing are only illustrative of preferred embodiments and modes of operation, not limiting thereto, and that the true spirit and scope of the present invention be determined by reference to the appended claims.

What is claimed is:

1. A message center consisting essentially of a substantially rectangular tray having peripheral side walls, a raised peripheral edge adjacent the side walls and at least one raised dividing wall having dividing wall ends, the dividing wall being connected on its ends to the raised peripheral edge thereby defining at least first and second recessed sections, wherein said first recessed section includes a non-electronic visual display component selected from the group consisting of an erasable board, a calendar, a pressure sensitive adhesive surface area, a cork board, a felt pad, a clip board, a note pad, a metal surface and a display area having a removable transparent film, and said second recessed section includes an audio record/playback device, and wherein at least one of the peripheral side walls contains an opening for holding a writing utensil and at least one of the peripheral side walls contains a battery compartment slidably insertable therethrough, the message center also includes a back cover attached to the tray defining a cavity on an opposite side of the tray from the recessed sections between the back cover and the tray, the back cover including means for attaching the message center to a surface.

2. The message center of claim 1 wherein said audio record/playback device comprises a digital record/playback device.

3. The message center of claim 1 wherein said tray contains at least two raised dividing walls having dividing wall ends attached to the raised peripheral edge defining first, second and third recessed sections.

4. The message center of claim 3 wherein said first recessed section contains an erasable board and the third recessed section contains a display area containing a removable transparent film.

5. The message center of claim 3 wherein said third recessed section comprises an interchangeable display component.

6. The message center of claim 1 wherein said means for attaching comprises one or more magnets.

7. The message center of claim 1 wherein said means for attaching comprises one or more apertures, hoops or slots for attaching said tray to a wall.

8. The message center of claim 1 wherein said audio record/playback device stores a plurality of messages in a queue.

9. The message center of claim 1 wherein said audio record/playback device contains a plurality of mailboxes for storing messages.

10. The message center of claim 1 wherein the battery compartment comprises a battery drawer.

11. A message center for visual and electronic messages consisting essentially of a molded rectangular tray having side walls, the tray containing at least three recessed areas between the side walls on a first side thereof, raised dividing walls connected to the side walls defining the three recessed areas, a second side of the tray containing a cover attached to the tray providing a cavity between the cover and the tray, said cover containing means for attaching the tray to a substantially vertical surface, wherein at least two of the recessed areas include non-electronic visual display devices selected from the group consisting of an erasable board, a calendar, a pressure sensitive adhesive surface area, a cork board, a felt pad, a clip board, a note pad, a metal surface and a display area having a removable transparent film, and the third recessed area contains a digital audio record/playback device wherein electronic components of the audio record/playback device are non-removably attached to the tray on a side opposite the recessed areas.

12. The message center of claim 11 wherein said digital audio record/playback device contains a plurality of mailboxes for storing messages.

13. The message center of claim 11 wherein a first recessed area comprises an erasable board and second recessed area contains a user changeable display device selected from the group consisting of a calendar, a pressure sensitive adhesive surface area, a cork board, a felt pad, a clip boards a note pad, a metal surface and a display area having a removable transparent film.

14. The message center of claim 11 wherein at least two of the recessed areas contain user changeable display devices selected from the group consisting of an erasable board, a calendar, a pressure sensitive adhesive surface area, a cork board, a felt pad, a clip board, a note pad, a metal surface and a display area having a removable transparent film.

15. The message center of claim 11 wherein the audio record/playback device includes a battery drawer sildably inserted in through one of the side walls of the tray.

* * * * *